US008603711B2

(12) United States Patent
Tani et al.

(10) Patent No.: US 8,603,711 B2
(45) Date of Patent: Dec. 10, 2013

(54) PIGMENT DISPERSION AND YELLOW TONER

(75) Inventors: Yutaka Tani, Yokohami (JP); Masao Nakano, Kamakura (JP); Takayuki Ujifusa, Ashigarakami-gun (JP); Taichi Shintou, Saitama (JP); Kaoru Takahashi, Saitama (JP); Satoshi Saito, Mishima (JP); Tomoyuki Noda, Tokyo (JP); Takeshi Miyazaki, Yokohama (JP); Masashi Hirose, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/426,178

(22) Filed: Mar. 21, 2012

(65) Prior Publication Data

US 2012/0251939 A1 Oct. 4, 2012

(30) Foreign Application Priority Data

Mar. 29, 2011 (JP) ..... 2011-072822

(51) Int. Cl.
*G03G 9/087* (2006.01)

(52) U.S. Cl.
USPC ..... 430/108.23; 106/496

(58) Field of Classification Search
USPC ..... 430/108.23; 106/496
See application file for complete search history.

(56) References Cited

U.S. PATENT DOCUMENTS 6,860,930 B2 * 3/2005 Wu et al. ..... 106/31.29
2011/0146537 A1 * 6/2011 Goredema et al. ..... 106/311

FOREIGN PATENT DOCUMENTS

BE 612657 A1 5/1962
JP 2004-184562 * 7/2004
WO 9942532 A1 8/1999

OTHER PUBLICATIONS

Translation of JP 2004-184562 published Jul. 2004.*

*Primary Examiner* — Peter Vajda
(74) *Attorney, Agent, or Firm* — Canon USA Inc. IP Division

(57) ABSTRACT

To obtain a pigment dispersion and a yellow toner having high coloring power and high dispersibility of a pigment in a dispersion medium, a pigment dispersion containing a compound represented by general formula (1) and a yellow pigment represented by general formula (2) are provided in a dispersion medium.

General Formula (1)

General Formula (2)

6 Claims, 2 Drawing Sheets

PIGMENT DISPERSION AND YELLOW TONER

BACKGROUND OF THE INVENTION

1. Field of the Invention

The present invention relates to a pigment dispersion used in a production process of a paint, an ink, a toner and a resin molding, and yellow toner for a recording method such as electrophotography, electrostatic recording, magnetic recording, toner-jet method and liquid development method.

2. Description of the Related Art

An azo pigment is widely used for a coloring agent such as a paint, an ink-jet ink, an electrophotographic toner and a color filter. When using an azo pigment in those fields, an azo pigment is required to finely dispersed in a solvent to improve the spectral property such as the coloring power and the transparency. However, when an azo pigment becomes fine, an azo pigment is generally aggregated in a dispersion process or the following production process, and deterioration of the coloring power or the transparency occurs.

To solve these problems, various kinds of pigment dispersants have been proposed. International Patent Application Laid-Open No. 9942532 describes a pigment dispersant represented by Solsperse (registered trademark, manufactured by Lubrizol Corporation). However, a pigment dispersant described in Patent Literature 1 is not sufficient to disperse in a nonpolar solvent such as styrene monomer.

Further, as described in Belgian Patent No. 612657, an acetoacetanilide-type monoazo compound has been used for a yellow or red coloring agent (pigment).

SUMMARY OF THE INVENTION

Aspects of the present invention related to a pigment dispersion containing a compound represented by general formula (1) and a yellow pigment represented by general formula (2) in a dispersion medium:

General Formula (1)

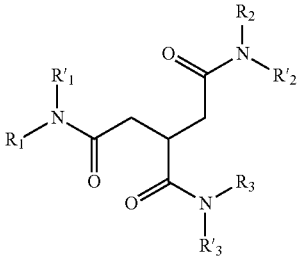

General Formula (2)

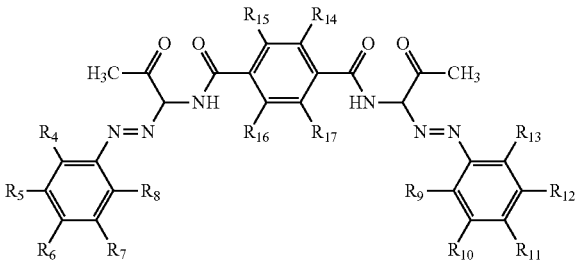

in the general formula (1), $R_1$ to $R_3$ and $R'_1$ to $R'_3$ each represents a hydrogen atom, an alkyl group, an aryl group or an aralkyl group; and in the general formula (2), $R_4$ to $R_{13}$ each represents a hydrogen atom, an alkyl group, a carboxylate ester group, a carboxylic amide group or a halogen atom, and $R_{14}$ to $R_{17}$ each represents a hydrogen atom, an alkyl group or a halogen atom.

Aspects of the present invention also relate to a yellow toner which is produced with the pigment dispersion mentioned above.

According to aspects of the present invention, increase in the viscosity of a pigment dispersion is controlled, and a pigment dispersion having good handling ability can be obtained.

Further, the dispersibility of a coloring agent in a dispersion medium can be improved. And when producing a yellow toner with the pigment dispersion, a coloring agent is well dispersed in the toner and the toner has high coloring power.

DESCRIPTION OF THE EMBODIMENTS

<A Pigment Dispersion>

Figure 1:
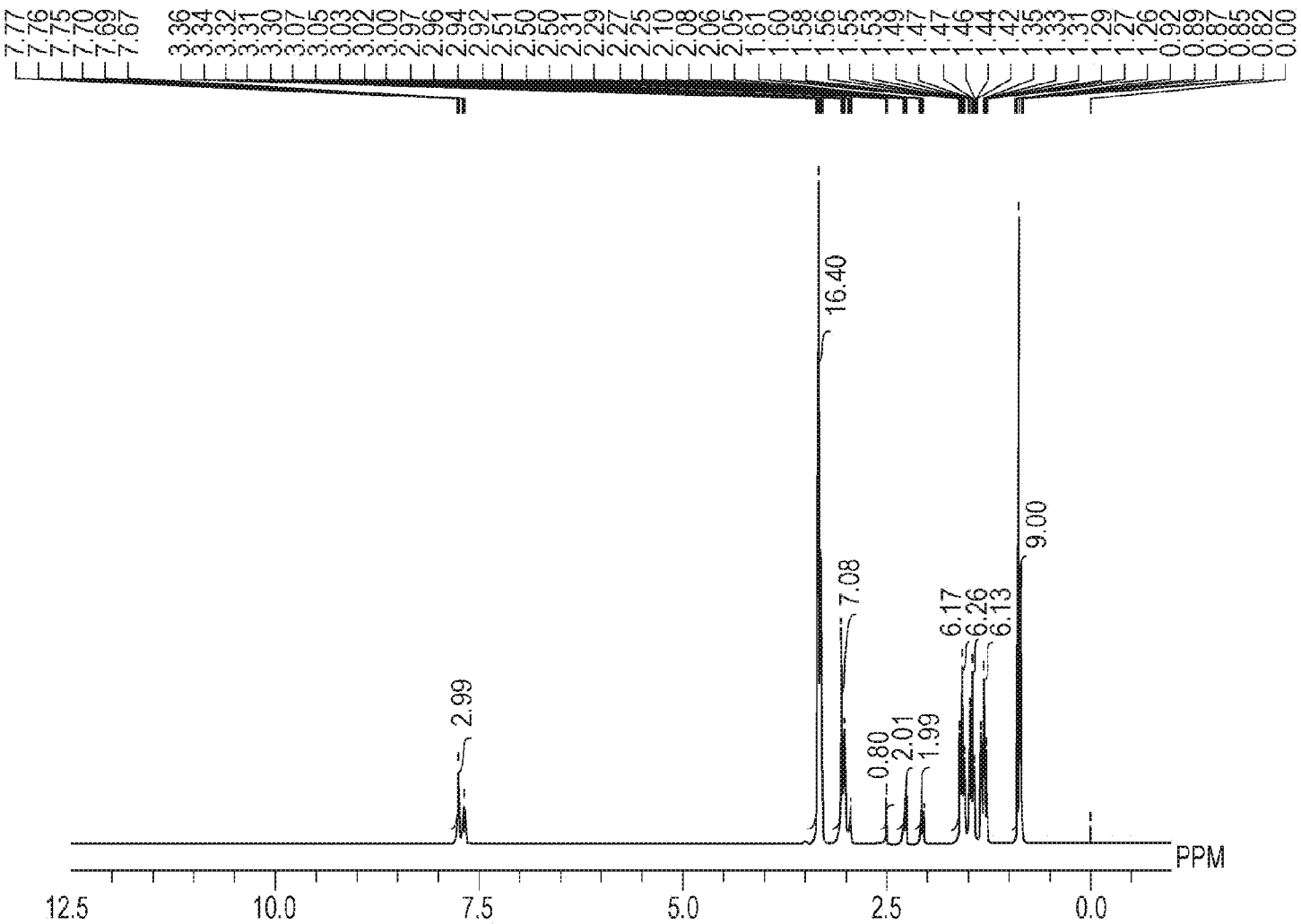
FIG. 1 is a 1H NMR spectrum of a compound (7) in DMSO-d6 at room temperature and 400 MHz.

The inventors have been pursuing improvements to solve problems of conventional technology, and discovered that a pigment dispersion including a compound represented by general formula (1) and a yellow pigment represented by general formula (2) in a dispersion medium has excellent pigment dispersibility. Further, the inventors also discovered that a yellow toner produced with the pigment dispersion has high coloring power. According to aspects of the present invention, a dispersion medium represents water, a organic solvent or a mixture of water and a organic solvent.

General Formula (1)

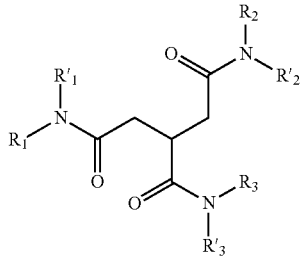

General Formula (2)

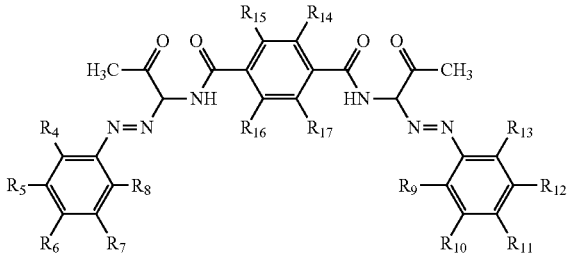

In the general formula (1), $R_1$ to $R_3$, and $R'_1$ to $R'_3$ each represents a hydrogen atom, an alkyl group, an aryl group or an aralkyl group.

The alkyl group of $R_1$ to $R_3$ and $R'_1$ to $R'_3$ in the general formula (1) is not particularly limited. Examples of the alkyl group include linear, branched or cyclic alkyl groups having 1 to 20 carbon atoms such as a methyl group, a butyl group, an octyl group, a dodecyl group, a nonadecyl group, a cyclobutyl group, a cyclopentyl group, a cyclohexyl group, a methyl cyclohexyl group and an ethyl hexyl group.

The aryl group of $R_1$ to $R_3$ and $R'_1$ to $R'_3$ in the general formula (1) is not particularly limited. Examples of the aryl group include monocyclic and polycyclic aryl group having six to fourteen membered-ring such as a phenyl group and a naphthyl group.

The aralkyl group of $R_1$ to $R_3$ and $R'_1$ to $R'_3$ in the general formula (1) is not particularly limited. Examples of the aralkyl group include a benzil group and a phenethyl group.

$R_1$ to $R_3$ and $R'_1$ to $R'_3$ in the general formula (1) represents substituents mentioned above, and these substituents can have an extra substituent as long as the stability of the compound is not considerably inhibited. In this case, examples of the substituent include an alkyl group such as a methyl group, an ethyl group, a propyl group, and a butyl group; an aryl group such as a phenyl group; an alkoxy group such as a methoxy group, an ethoxy group, and a butoxy group; a monosubstituted amino group such as a methyl amino group, and a propyl amino group; a disubstituted amino group such as a dimethylamino group, a dipropylamino group, and a N-ethyl-N-phenyl group.

In the general formula (1), $R_1$, $R_2$, and $R_3$ represent the same substituent, and $R'_1$, $R'_2$, and $R'_3$ represent the same substituent. In this case, the compound represented by the general formula (1) can be easily produced and the production cost can be reduced.

$R_1$ to $R_3$ in the general formula (1) may be an alkyl group because the dispersibility of the compound represented by the general formula (1) to a solvent is improved and the dispersibility of the pigment is improved. Especially, $R_1$ to $R_3$ in the general formula (1) may respectively represent a branched substituent such as a cyclohexyl group, a methyl cyclohexyl group, and an ethyl hexyl; or a hetero atom-containing structure such as a butoxy propyl group. $R'_1$ to $R'_3$ in the general formula (1) may be a hydrogen atom.

Concrete examples of the compound represented by the general formula (1) are shown below. The compound represented by the general formula (1) is not limited in the following examples.

Compound (1)

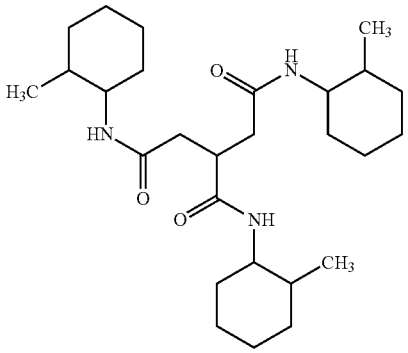

-continued

Compound (2)

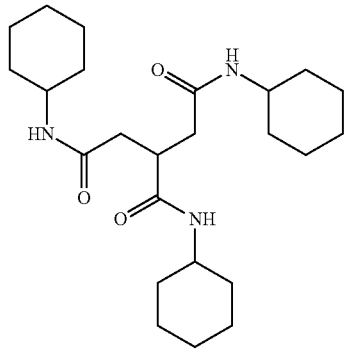

Compound (3)

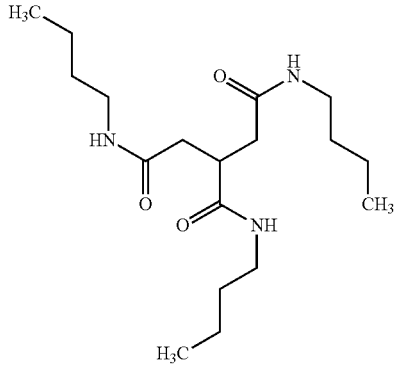

Compound (4)

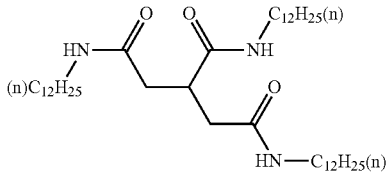

Compound (5)

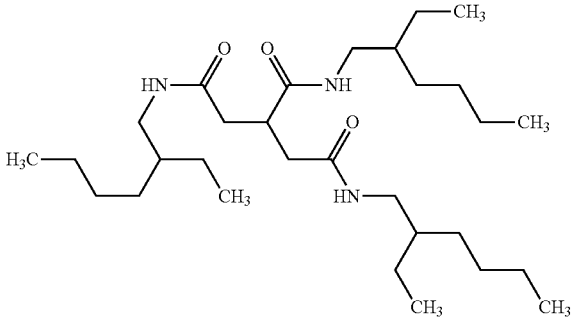

Compound (6)

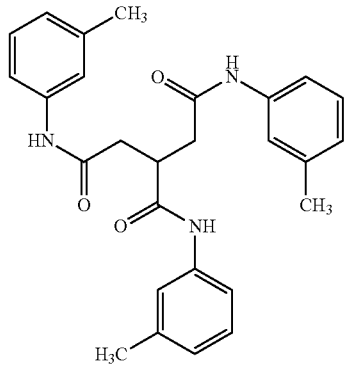

-continued

Compound (7)

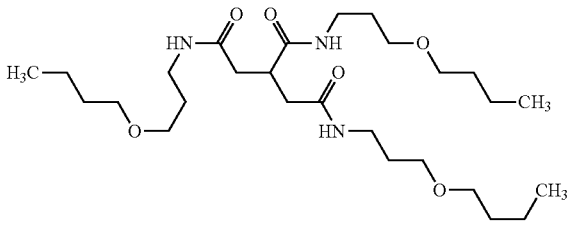

Compound (8)

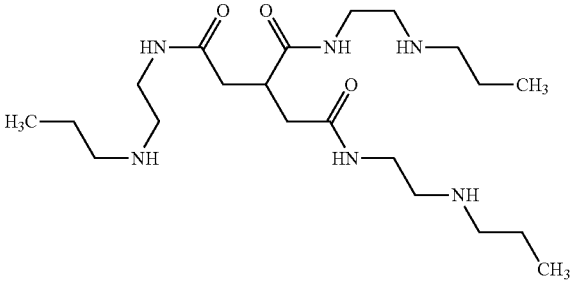

Compound (9)

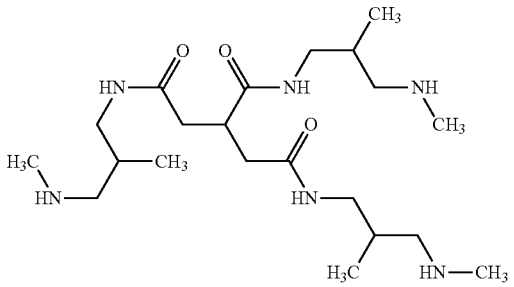

Compound (10)

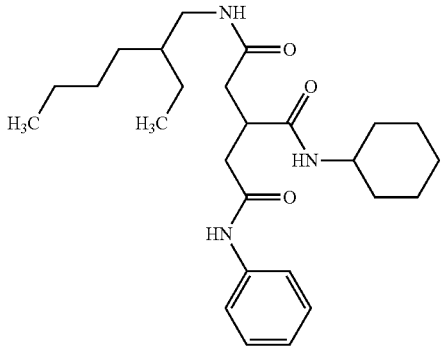

Compound (11)

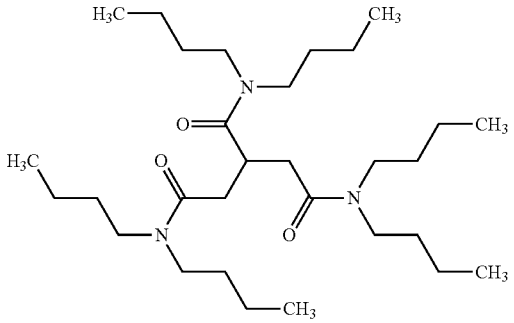

-continued

Compound (12)

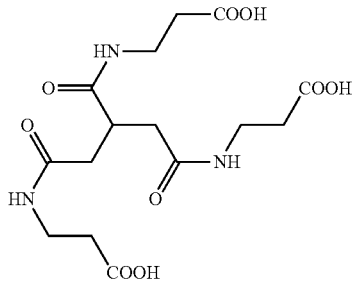

Compoiund (13)

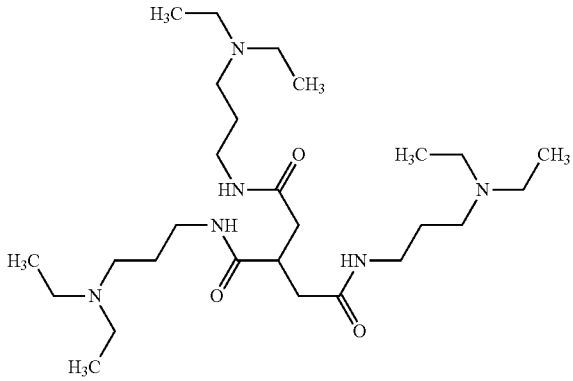

When the alkyl group of $R_1$ to $R_3$ in the general formula (1) includes a ring structure as the compound (1) and the compound (2), includes a branched structure as the compound (5), or includes a hetero atom as the compound (7), high performance can be obtained.

Next, an example of the production method of the compound represented by the general formula (1) is shown below. By condensation of the compound A and an amine or an amine derivative, the compound B can be obtained. And then, by condensation of the compound B and an amine or an amine derivative which is the same as or different from the previous one, compound C can be obtained. And conventional reaction such as protection, deprotection and hydrolysis can be optionally applied to the functional groups of each compound. The production method of the compound represented by general formula (1) is not limited in the manner described above.

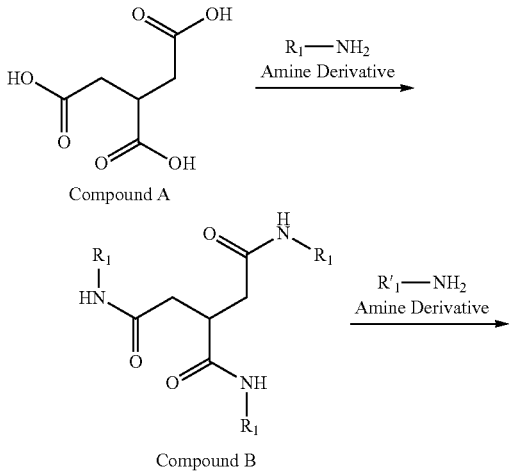

-continued

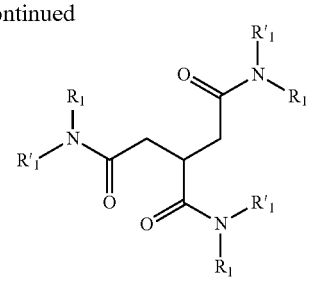

Compound C

In the general formula (2), $R_4$ to $R_{13}$ each represents a hydrogen atom, an alkyl group, a carboxylate ester group, a carboxylic amide group or a halogen atom. $R_{14}$ to $R_{17}$ each represents a hydrogen atom, an alkyl group or a halogen atom.

The alkyl group of $R_4$ to $R_{13}$ and $R_{14}$ to $R_{17}$ in the general formula (2) is not particularly limited. Examples of the alkyl group include a methyl group, an ethyl group, a propyl group, and a butyl group.

The carboxylate ester group of $R_4$ to $R_{13}$ in the general formula (2) is not particularly limited. Examples of the carboxylate ester group include a carboxylic methyl ester group, a carboxylic ethyl ester group, a carboxylic propyl ester group, and a carboxylic butyl ester group.

The carboxylic amide group of $R_4$ to $R_{13}$ in the general formula (2) is not particularly limited. Examples of the carboxylic amide group include a monosubstituted amide group such as a carbamoyl group, a carboxylic methylamide group, a carboxylic butylamide group, a carboxylic hexylamide group, and a carboxylic phenylamide group; a disubstituted amide group such as a carboxylic dimethylamide group, a carboxylic diphenylamide group, and a carboxylic methyl propyl amide group.

$R_4$ to $R_{13}$ in the general formula (2) represents substituents mentioned above, and these substituents can have an extra substituent as long as stability of the compound is not considerably inhibited. In this case, examples of the substituent include an alkyl group such as a methyl group, an ethyl group, a propyl group, and a butyl group; an aryl group such as a phenyl group; an alkoxy group such as a methoxy group, an ethoxy group, and a butoxy group; a monosubstituted amino group such as a methyl amino group, and a propyl amino group; a disubstituted amino group such as a dimethylamino group, a dipropylamino group, and a N-ethyl-N-phenyl group; and a halogen atom.

Example of the halogen atom of $R_4$ to $R_{13}$ and $R_{14}$ to $R_{17}$ in the general formula (2) include a fluorine atom, a chlorine atom, a bromine atom, and an iodine atom.

Examples of the yellow pigment represented by the general formula (2) include C.I. Pigment Yellow 93, C.I. Pigment Yellow 94, C.I. Pigment Yellow 95, C.I. Pigment Yellow 128, C.I. Pigment Yellow 155, and C.I. Pigment Yellow 214 and derivatives thereof. Especially C.I. Pigment Yellow 155 may be used because of its high coloring power.

These yellow pigments represented by general formula (2) can be used alone or in combination with two or more. Also the yellow pigment represented by general formula (2) can be used in combination with one or more conventional coloring agents.

The pigment dispersion according to aspects of the present invention may be obtained by dispersing the compound represented by general formula (1) and the yellow pigment represented by general formula (2) into a dispersion medium. For concrete example, the following method can be used. The compound represented by the general formula (1) and an optional resin are dissolved in a dispersion medium, and a powder of the pigment represented by general formula (2) is gradually added in the dispersion medium with stirring to be sufficiently dispersed in the dispersion medium. And then, by adding mechanical shear force to the dispersion medium by a dispersing machine such as a ball mill, a paint shaker, a dissolver, Attritor, a sand mill or a high-speed mill, the pigment can be finely dispersed as stable and uniform fine particles.

The amount of the yellow pigment in the pigment dispersion may be in the range of 1.0 to 30.0 parts by mass with respect to 100 parts by mass of a dispersion medium. The amount of the yellow pigment may be in the range of 2.0 to 20.0 parts by mass and even 3.0 to 15.0 parts by mass. When the amount of the yellow pigment is in the above range, increase of the viscosity or deterioration of pigment dispersibility can be prevented and coloring power can be obtained.

The content of the compound represented by the general formula (1) may be in the range of 0.05 to 10 parts by mass and even 0.1 to 5.0 parts by mass with respect to 100 parts by mass of the yellow pigment represented by the general formula (2).

The pigment dispersion can be dispersed in water with an emulsifier. Examples of an emulsifier include a cationic surfactant, an anionic surfactant, and a nonionic surfactant. Examples of a cationic surfactant include dodecyl ammonium chloride, dodecyl ammonium bromide, dodecyl trimethyl ammonium bromide, dodecyl pyridinium chloride, dodecyl pyridinium bromide, and hexadecyl trimethyl ammonium bromide. Examples of an anionic surfactant include a fatty acid soap such as sodium stearate and sodium dodecanoate, sodium dodecyl sulfate, sodium dodecylbenzene sulfate, and sodium lauryl sulfate. Examples of a nonionic surfactant include dodecylpolyoxyethylene ether, hexadecylpolyoxyethylene ether, nonylphenylpolyoxyethylene ether, laurylpolyoxyethylene ether, and monodecanoyl sucrose.

Examples of an organic solvent used as a dispersion medium includes alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzil alcohol, and cyclohexanol; glycols such as methyl cellosolve, ethyl cellosolve, diethylene glycol, and diethylene glycol monobutyl ether; ketones such as acetone, methyl ethyl ketone, and methyl isobutyl ketone; esters such as ethyl acetate, butyl acetate, ethyl propionate, and cellosolve acetate; hydrocarbons such as hexane, octane, petroleum ether, cyclohexane, benzene, toluene, and xylene; hydrocarbon halides such as carbon tetrachloride, trichloroethylene, and tetrabromoethane; ethers such as diethyl ether, trioxane, and tetrahydrofuran; acetals such as methylal, and diethyl acetal; organic acids such as formic acid, acetic acid, and propionic acid; and organic compounds containing sulfur or nitrogen atom such as nitro benzene, dimethylamine, monoethanolamine, pyridine, dimethylsulfoxide, and dimethylformamide.

Also, a polymerizable monomer can be used as an organic solvent. A polymerizable monomer may be an addition polymerizable monomer or a condensation polymerizable monomer, and even an addition polymerizable monomer. Concrete examples of a polymerizable monomer include a styrene-based monomer such as styrene, o-methylstyrene, m-methylstyrene, p-methylstyrene, o-ethylstyrene, m-ethylstyrene, and p-ethylstyrene; an acrylate-based monomer such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylamide; a methacrylate-based monomer such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylamide; an olefin-based monomer such as ethylene, propylene, butylene, butadiene, isoprene, isobutylene, and cyclohexene; vinyl halides such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, and vinyl isobutyl ether; and vinyl ketones such as vinyl methyl ketone, vinyl hexyl ketone, and methyl isopropenyl ketone. These compounds can be used alone or in combination in response to the purpose. When producing a polymerization toner using the pigment dispersion according to aspects of the present invention, styrene or a styrene-based monomer may be used alone or in combination with other polymerizable monomer. Even styrene may be used because of the handling ability.

A resin can be added to the pigment dispersion. Concrete examples of a resin include a polystyrene resin, a styrene copolymer, a polyacrylic acid resin, a polymethacrylic acid resin, a polyacrylic acid ester resin, a polymethacrylic acid ester resin, an acrylate-based copolymer, a methacrylate-based copolymer, a polyester resin, a polyvinyl ether resin, a polyvinyl methyl ether resin, a polyvinyl alcohol resin, a polyvinylbutyral resin, polyurethane resin, and polypeptide resin. These resins can be used alone or in combination.

The viscosity of the pigment dispersion may be in the range of 100 to 2000 mPa·s, even 200 to 1500 mPa·s, and even 300 to 1300 mPa·s at 25° C. When the viscosity of the pigment dispersion is in above range, the yellow pigment is sufficiently finely dispersed in the dispersion medium. Further when using the pigment dispersion for producing a polymerization toner, the pigment is efficiently dispersed and the pigment dispersion is easily transported after dispersion treatment.

<Toner>

The pigment dispersion according to aspects of the present invention may be used as a coloring agent when producing a toner particle including a binder resin, a yellow pigment, a wax component and the like. By using the pigment dispersion according to aspects of the present invention as a coloring agent, the increase in the viscosity of the pigment dispersion can be prevented. So, the handling ability in the toner production process becomes easy and the dispersibility of the coloring agent may be maintained. Consequently the yellow toner having high coloring power can be obtained.

Examples of a binder resin used for a toner include a styrene-methacrylic acid copolymer, a styrene-acrylic acid copolymer, a polyester resin, an epoxy resin, and a styrene-butadiene copolymer. When obtaining toner particles directly by a polymerization method, a polymerizable monomer is used to form the particles. Examples of a polymerizable monomer include a styrene-based monomer such as styrene, α-methylstyrene, α-ethylstyrene, o-methylstyrene, m-methylstyrene, p-methylstyrene, o-ethylstyrene, m-ethylstyrene, and p-ethylstyrene; a methacrylate ester-based monomer such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylamide; an acrylate ester-based monomer such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylamide; and an olefin-based monomer such as butadiene, isoprene, and cyclohexene. These binder resins can be used alone or in combination so as to be in the range of 40 to 75° C. of theoretical glass transition temperature (Tg), which is described in page 139 to 192 of Polymer Handbook second edition III (published by John Wiley & Sons, Ltd.).

A toner may contain a polar resin such as a polyester resin and a polycarbonate resin. For example, when producing toner particles by suspension polymerization method or the like, and adding a polar resin in a dispersion process through a polymerization process, added polar resin forms a thin layer on the surface of the toner particle or exists in the toner particle where the density of the polar resin gradually increases from the core to the surface in accordance with the polarity balance of a polymerizable monomer composition and an aqueous dispersion medium. In this case, the coloring agent can exist in the toner particle by using the pigment dispersion according to aspects of the present invention.

In the process of producing the binder resin, a cross-linking agent can be used to improve the mechanical strength of the toner particle and controlling the molecular weight of the binder resin. Examples of a bifunctonal cross-linking agent include divinylbenzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200, #400, #600, dipropylene glycol diacrylate, polypropylene glycol diacrylate, polyester-type diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, tetraethylene glycol dimethacrylate, dipropylene glycol dimethacrylate, polypropylene glycol dimethacrylate, and polyester-type dimethacrylate. Examples of a polyfunctional cross-linking agent include pentaerythritol triacrylate, trimethylolethane triacrylate, trimethylolpropane triacrylate, tetramethylolmethane tetraacrylate, oligoester acrylate, pentaerythritol trimethacrylate, trimethylolethane trimethacrylate, trimethylolpropane trimethacrylate, tetramethylolmethane tetramethacrylate, oligoester methacrylate, 2,2-bis(4-mathacryloxyphenyl)propane, diallyl phthalate, triallyl cyanurate, triallyl isocyanurate and triallyl trimellitate. These cross-linking agents may be used 0.05 to 10 parts by mass and even 0.1 to 5 parts by mass with respect to 100 parts by mass of the polymerizable monomer.

When producing the toner according to aspects of the present invention, another coloring agent may be used besides the pigment dispersion according to aspects of the present invention as long as the dispersibility of the pigment dispersion is not inhibited. Examples of the coloring agent include a condensed azo compound, an anthraquinone compound, an azo metal complex, a methine compound, and allyl amide compound.

Examples of a wax component used for a toner include a petroleum-based wax such as a paraffin wax, a microcrystalline wax, and a petrolatum and the derivatives thereof; a montan wax and the derivative thereof; a hydrocarbon wax obtained by Fischer-Tropsch process and the derivative thereof; a polyolefin wax such as a polyethylene wax and the derivative thereof; a natural wax such as a carnauba wax, and a candelilla wax and the derivatives thereof. The derivatives above mentioned include an oxide, a block copolymer made by a vinyl monomer, and a graft modified product. Also an alcohol such as a higher aliphatic alcohol; an aliphatic acid such as stearic acid, and palmitic acid and the derivatives thereof; a hardened castor oil and the derivative thereof; a plant wax, and an animal wax can be mentioned. These waxes can be used alone or in combination.

The addition amount of a wax component may be in the range of 2.5 to 15.0 parts by mass and even 3.0 to 10.0 parts by mass with respect to 100 parts by mass of a binder resin.

A charge control agent can be optionally used by mixing with toner particles. This enables to control the amount of a triboelectric charge of a toner in accordance with requirement of a developing system.

A conventional charge control agent may be used, especially a charge control agent which charges quickly and keeps the charge amount steadily may be used. Moreover, when producing a toner by a direct polymerization method, a charge control agent which has the low polymerization inhibition property and substantially has no soluble matter of an aqueous dispersion medium may be used.

Examples of a charge control agent which controls toner to have a negative charge include a polymer and a copolymer with a sulfonic acid group, a sulfonic acid salt group or a sulfonic acid ester group; a salicylic acid derivative and the metal complex thereof; a monoazo metal compound, and a acetylacetone metal compound; an aromatic oxycarboxylic acid, aromatic mono or polycarboxylic acid and the metallic salt and the anhydride thereof; an esters; a phenol derivative such as bisphenol; a urea derivative; a metal-containing naphthoic acid-based compound; a boron compound; a quaternary ammonium salt; a calixarene; and a resin-based charge control agent.

Examples of a charge control agent which controls toner to have a positive charge include a nigrosine modified compound made by nigrosine and a fatty acid metal salt; a guanidine compound; an imidazole compound; a quaternary ammonium salt such as tributylbenzylammonium 1-hydroxy-4-naphthosulfonate salt, and tetrabutylammonium tetrafluoroborate and the analog of the onium salt such as a phosphonium salt and the lake pigment thereof; a triphenylmethane dye and the lake pigment thereof (examples of a laking agent include phosphorus tungstate, phosphorus molybdate, phosphorus tungsten molybdate, tannic acid, lauric acid, gallic acid, ferricyanide, and ferrocyanide); a metallic salt of a higher fatty acid; a diorgano tin oxide such as dibutyl tin oxide, dioctyl tin oxide, and dicyclohexyl tin oxide; diorgano tin borates such as dibutyl tin borate, dioctyl tin borate, and dicyclohexyl tin borate; and resin-based charge control agent. These compounds can be used alone or in combination.

An inorganic fine powder as a fluidizer may be externally added to a toner. Examples of an inorganic fine powder include a silica, a titanium oxide, and an alumina, the complex oxide thereof, and surface-treated inorganic fine power thereof.

Examples of a production method to obtain toner particles include a conventional production method such as a pulverizing method, a suspension polymerization method, a suspension granulation method, and an emulsion polymerization method. Of those methods, a production method of granulating toner particles in an aqueous medium such as a suspension polymerization method, and a suspension granulation method may be used from the aspect of the environment load in the production process and the controllability of the particle diameter.

A production method of toner particles by a suspension polymerization method is described below. First, a pigment dispersion, a polymerizable monomer, a wax component, a polymerization initiator and the like are mixed to prepare a polymerizable monomer composition. Next, the polymerizable monomer composition is dispersed in an aqueous medium and granulated to make particles of the polymerizable monomer composition. And then, the polymerizable monomer in the polymerizable monomer composition particles is polymerized in the aqueous medium to obtain toner particles.

A polymerizable monomer composition may be prepared by mixing a dispersion solution which is made by dispersing the coloring agent in first polymerizable monomer, and second polymerizable monomer. That is, after sufficiently dispersing the pigment composition in first polymerizable monomer, the pigment composition and first polymerizable monomer are mixed with second polymerizable monomer and other toner material. This enables the pigment to exist in the toner particles as a dispersion state.

Examples of a polymerization initiator used for a suspension polymerization method include an azo-based polymerization initiator such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis (isobutyrate); an organic peroxide-based polymerization initiator such as benzoyl peroxide, di-tert-butyl peroxide, tert-butylperoxyisopropyl monocarbonate, tert-hexylperoxy benzoate, and tert-butylperoxy benzoate; an inorganic peroxide-based polymerization initiator such as potassium persulfate, and ammonium persulfate; and redox initiators of hydrogen peroxide-ferrous-based, BPO-dimethylaniline-based, and cerium (IV) salt-alcohol-based. Examples of a photopolymerization initiator include initiators of acetophenone-based, benzoin ether-based, and ketal-based. These polymerization initiator can be used alone or in combination.

The concentration of a polymerization initiator may be in the range of 0.1 to 20 parts by mass and even 0.1 to 10 parts by mass with respect to 100 parts by mass of a polymerizable monomer. A polymerization initiator can be used alone or in combination by reference to its 10 hours half-life temperature.

A dispersion stabilizer may be contained in an aqueous medium used for a suspension polymerization method. As a dispersion stabilizer, a conventional inorganic and organic dispersion stabilizer can be used. Examples of an inorganic dispersion stabilizer include a calcium phosphate, a magnesium phosphate, an aluminum phosphate, a zinc phosphate, a magnesium carbonate, a calcium carbonate, a calcium hydroxide, a magnesium hydroxide, an aluminum hydroxide, a calcium metasilicate, a calcium sulfate, a barium sulfate, a bentonite, a silica, and an alumina. Examples of an organic dispersion stabilizer include polyvinyl alcohol, a gelatin, methylcellulose, methylhydroxypropylcellulose, ethylcellulose, sodium salt of carboxymethylcellulose, and starch. Also a nonionic, an anionic and a cationic surfactant can be used such as sodium dodecyl sulfate, sodium tetradecyl sulfate, sodium pentadecyl sulfate, sodium octyl sulfate, sodium oleate, sodium laurate, potassium stearate, and calcium oleate.

In these dispersion stabilizers, a hardly water-soluble inorganic dispersion stabilizer which is soluble in an acid may be used. When preparing an aqueous dispersion medium using a hardly water-soluble inorganic dispersion stabilizer, the dispersion stabilizer may be used in the range of 0.2 to 2.0 parts by mass with respect to 100 parts by mass of a polymerizable monomer for the stability of the liquid particles in an aqueous medium of a polymerizable monomer composition. An aqueous medium may be prepared by using water in the range of 300 to 3000 parts by mass with respect to 100 parts by mass of a polymerizable monomer composition.

When preparing an aqueous medium where a hardly water-soluble inorganic dispersion stabilizer is dispersed, commercially available dispersion stabilizer may be directly added in a water solvent and dispersed. And even, to obtain fine and uniform dispersion stabilizer particles, a hardly water-soluble inorganic dispersion stabilizer may be formed in water under high speed stirring. For example, when using calcium phosphate as a dispersion stabilizer, adispersion stabilizer can be obtained by mixing a sodium phosphate aqueous solution and a calcium chloride aqueous solution under high speed stirring to form fine particles of calcium phosphate.

The pigment dispersion according to aspects of the present invention can be used for a suspension granulation method. Because there is no heating process in the processes of a suspension granulation method, compatibilization of a resin and a wax component can be controlled in case of using a low-melting point wax, and lowering of the glass transition temperature of a toner caused by compatibilization can be prevented. Further, when using a suspension granulation method, toner materials to form a binder resin can be widely used, and a polyester resin having good fixability can be easily used as a main component of toner. A suspension granulation method has the advantage of producing a toner having resin composition which cannot be obtained by a suspension polymerization method.

For example, toner particles are produced by a suspension granulation method as shown below. First, a pigment dispersion, a binder resin, a wax component and the like are mixed in a solvent to prepare a solvent composition. Next, the solvent composition is dispersed in an aqueous medium to granulate solvent composition particles and form a toner particle suspension. And then, the solvent of the toner particle suspension was removed by heating or pressure reduction to obtain toner particles.

The solvent composition may be prepared whereby a dispersion solution made by dispersing a coloring agent in first solvent and second solvent are mixed. That is, after sufficiently dispersing a pigment composition in first solvent, the pigment composition and first solvent are mixed with other toner materials and second solvent. This enables a pigment to exist in toner particles at a dispersion state.

Examples of a solvent used for a suspension granulation method include hydrocarbons such as toluene, xylene, and hexane; halogen-containing hydrocarbons such as methylene chloride, chloroform, dichloroethane, trichloroethane, and carbon tetrachloride; alcohols such as methanol, ethanol, butanol, and isopropyl alcohol; polyhydric alcohols such as ethylene glycol, propylene glycol, diethylene glycol, and triethylene glycol; cellosolves such as methyl cellosolve, and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. These solvents can be used alone or in combination. In these solvents, a solvent which has low melting point and can sufficiently solve a binder resin may be used because a solvent can be easily removed from a toner particle suspension.

Use amount of a solvent may be 50 to 5000 parts by mass and even 120 to 1000 parts by mass with respect to 100 parts by mass of a binder resin.

An aqueous medium used for a suspension granulation method may contain a dispersion stabilizer. In this case, the dispersion stabilizers mentioned at the description of a suspension polymerization method can be used.

The weight average particle diameter D4 of a toner may be in the range of 4.0 to 8.0 μm, and the ratio of the weight average particle diameter D4 to the number average particle diameter D1, D4/D1, may be 1.35 or less. Further, the weight average particle diameter D4 may be in the range of 4.9 to 7.5 μm, and D4/D1 may be 1.30 or less. The adjusting method of the weight average particle diameter D4 of a toner and the number average particle diameter D1 varies from producing methods of toner particles. In case of a suspension polymerization method, D4 and D1 are adjusted by controlling a dispersant concentration, reaction stirring speed, stirring time or the like in the process of preparing an aqueous dispersion medium.

An average circularity of a toner measured by a flow-type particle image analyzer may be in the range of 0.950 to 0.995, and even 0.960 to 0.990 in the light of considerable improvement of toner transferability.

A yellow toner according to aspects of the present invention can be used as a magnetic toner containing a magnetic material. Examples of a magnetic material include an iron oxide such as a magnetite, a maghemite, and a ferrite; an iron oxide containing other metallic oxide; a metal such as Fe, Co, and Ni; a alloy of metals such as Fe, Co, Ni, Al, Co, Cu Pb, Mg, Ni, Sn, Zn, Sb, Be, Bi, Cd, Ca, Mn, Se, Ti, W, and V; and a mixture thereof.

<Liquid Developer>

The pigment dispersion according to aspects of the present invention can be used for a liquid developer, a developer used for a liquid development method. A producing method of a liquid developer is described below.

To obtain a liquid developer, the compound represented by the general formula (1), the yellow pigment represented by the general formula (2), dispersant resin, and optional auxiliary agent such as a charge control agent, a wax and the like are dispersed or dissolved in an electrical insulation carrier solvent. Also, two-step method where a condensed toner is prepared, and then the condensed toner is diluted with an electrical insulation carrier solvent to prepare a developer can be used.

Examples of a dispersing machine, which is not particularly limited, include a media type dispersing machine and a high pressure opposing collision type dispersing machine such as a rotary shear type homogenizer, a ball mill, a sand mill, and Attritor.

A coloring agent can be used alone or in combination.

A resin and a wax described above can be used.

Examples of a charge control agent, which is not limited as long as it is used for a liquid developer for an electrostatic developing method, include cobalt naphthenate, copper naphthenate, copper oleate, cobalt oleate, zirconium octylate, cobalt octylate, sodium dodecylbenzenesulfonate, calcium dodecylbenzenesulfonate, soybean lecithin, and aluminum octoate.

Examples of an electrical insulation carrier solvent include an aliphatic hydrocarbon solvent such as hexane, pentane, octane, nonane, decane, undecane, and dodecane; ISOPAR H, G, K, L, M (manufactured by ExxonMobil Chemical), LINEALENE DIMER A-20, and A-20H (manufactured by Idemitsu Kosan Co., Ltd.). The boiling point of an electrical insulation carrier solvent may be in the range of 68 to 250° C. These electrical insulation carrier solvents may be used alone or in combination as long as the viscosity of the system doesn't increase.

EXAMPLES

In the Examples, all "parts" and "%" are expressed in terms of mass unless otherwise noted. Reaction compound is identified by some analysis methods using the devices described below. 1H and 13C nuclear magnetic resonance spectrometry (ECA-400, manufactured by JEOL Ltd.), and LC/TOF MS (LC/MSD TOF, manufactured by Agilent Technologies) are used as analysis devices.

Production Example of a Compound Represented by the General Formula (1)

Compound (1), (4), (5), (7), (11), (12) and (13) are obtained as described below. Compound (1), (4), (5) (7), (11), (12) and (13) in the Examples respectively correspond to compound (1), (4), (5) (7), (11), (12) and (13) described at concrete example of the compound represented by the general formula (1).

Trade name "RIKACLEAR PC1" (manufactured by New. Japan Chemical Co., Ltd.) was commercially acquired and used as compound (1).

Production Example of Compound (4)

13.0 g of cresol (120 mmol), 7.0 g of 1,2,3-propanetricarboxylic acid (40 mmol), and 1.0 g of boron oxide (14.4 mmol) were dissolved in 150 ml xylene, and 44.5 g of n-dodecyl amine (240 mmol) was added to the xylene solution. The xylene solution was heated and refluxed for 6 hours for dehydration. After the reaction, the solution was concentrated, and then stirred at 50° C. for 1 hour for suspension washing in 150 ml of acetonitrile. The resultant solid was filtered to obtain 10.0 g of compound (4) (in 37% yield).

<Analysis Result of Compound (4)>

[1] 1H NMR (400 MHz, DMSO-d6, room temperature): δ [ppm]=0.85 (t, 9H, J=6.64 Hz), 1.17 (m, 60H), 2.50 (t, 11H, J=1.83 Hz), 7.64 (s, 1H), 8.03 (s, 1H), 10.8 (s, 1H)

[2] mass analysis (ESI-TOF): m/z=676.6414 $(M-H)^-$

Production Example of Compound (5)

7.3 g of compound (5) (in 36% yield) was obtained by performing the same procedure as Production Example of compound (4) except that 2-ethylhexyl amine was used instead of n-dodecyl amine.

<Analysis Result of compound (5)>

[1] 1H NMR (400 MHz, DMSO-d6, room temperature): δ [ppm]=0.80 (td, 9H, J=7.44, 3.51 Hz), 0.86 (t, 9H, J=6.87 Hz), 1.2 (t, 24H, 8.47 Hz), 1.32 (dd, 3H, J=11.7, 5.72 Hz), 2.10 (dd, 2H, J=14.7, 6.87 Hz), 2.32 (dd, 2H, J=14.9, 8.01 Hz), 2.50 (t, 1H, J=1.83 Hz), 2.96 (dtd, 6H, J=39.1, 13.1, 6.41 Hz), 7.60 (t, 1H, 6.00 Hz), 7.68 (t, 2H, 6.00 Hz)

[2] mass analysis (ESI-TOF): m/z=508.4524 $(M-H)^-$

Production Example of compound (7)

4.8 g of compound (7) (in 23% yield) was obtained by performing the same procedure as Production Example of compound (4) except that 3-butoxypropyl amine was used instead of n-dodecyl amine.

<Analysis Result of Compound (7)>

[1] 1H NMR (400 MHz, DMSO-d6, room temperature): δ [ppm]=0.92-0.82 (m, 9H), 1.3 (td, 6H, J=14.9, 7.48 Hz), 1.46 (dt, 6H, J=15.7, 5.95 Hz), 1.57 (td, 6H, J=13.3, 6.4 Hz), 2.07 (dd, 2H, J=14.7, 6.41 Hz), 2.28 (dd, 2H, J=14.7, 7.79 Hz), 2.5 (t, 1H, J=1.60 Hz), 2.99 (tt, 7H, J=22.4, 7.56 Hz), 3.36-3.30 (m, 12H), 7.72 (dt, 3H, J=29.5, 5.61 Hz)

[2] mass analysis (ESI-TOF): m/z=514.3906 $(M-H)^-$

1H NMR spectrum of compound (7) is shown in FIG. 1.

Production Example of Compound (11)

7.3 mL (100 mmol) of thionyl chloride was dropped into 0.2 mL of dimethylformamide solution of 3.5 g (20 mmol) of 1,2,3-propanetricarboxylic acid, then the solution was stirred at 90° C. for 2 hours. After concentrating under reduced pressure, the solution was diluted with 40 mL of dichloromethane. The solution was dropped into 100 mL of dichloromethane solution of 10 mL of triethylamine and 12.2 mL (72 mmol) of dibutylamine, then the mixed solution was stirred for 5 days.

After the reaction, the mixture solution was diluted with 400 mL of dichloromethane and washed with water, 1 mol/L hydrochloric acid solution, saturated sodium hydrogen carbonate aqueous solution and saturated sodium chloride solution. The organic layer was concentrated under reduced pressure, then the residue was purified with silica gel chromatography to obtain 7.37 g (in 72% yield) of compound (11)

<Analysis Result of Compound (11)>

[1] 1H NMR (400 MHz, $CDCl_3$, room temperature): δ [ppm]=0.99-0.84 (m, 18H), 1.69-1.23 (m, 24H), 2.53-2.45 (m, 2H), 2.63-2.55 (m, 2H), 3.31-3.12 (m, 10H), 3.46 (t, 2H, J=8.01 Hz), 3.75-3.68 (m, 1H)

[2] mass analysis (ESI-TOF): m/z=510.4699 (M+H)+

Production Example of Compound (12)

19.4 g (126.3 mmol) of β-alanine hydrochloride was suspended in 150 mL of dichloromethane. 5.56 g (31.6 mmol) of 1,2,3-propanetricarboxylic acid, 13.9 mL (126.3 mmol) of N-methylmorpholine and 24.2 g (126.3 mmol) of 1-ethyl-3-(3-dimethylaminopropyl)carbodiimide (EDCI) were added into the suspension, and then the suspension was stirred overnight at room temperature.

The reaction solution was diluted with 450 mL of dichloromethane, and then washed with water, 1 mol/L hydrochloric acid solution, saturated sodium hydrogen carbonate aqueous solution and saturated sodium chloride solution. The organic layer was concentrated under reduced pressure, then the residue was washed with ethanol and diethyl ether to obtain 11.2 g (in 75% yield) of compound (12)

<Analysis Result of Compound (12)>

[1] 1H NMR (400 MHz, $CDCl_3$, room temperature): δ [ppm]=2.07 (dd, 2H, J=14.88, 6.64 Hz), 2.31 (ddd, 8H, J=32.06, 15.57, 8.70 Hz), 2.96-2.88 (m, 1H), 3.20 (tt, 6H, J=19.23, 6.56 Hz), 7.75 (t, 1H, J=5.72 Hz), 7.85 (t, 2H, J=5.50 Hz), 12.19 (s, 3H)

[2] mass analysis (ESI-TOF): m/z=388.1697 (M+H)+

Production Example of Compound (13)

12.6 mL (80 mmol) of N,N-diethyl-1,3-diaminopropane and 22.1 g (80 mmol) of 4-(4,6-dimethoxy-1,3,5-triazin-2-yl)-4-methylmorpholinium chloride (DMT-MM) were added into 80 mL of methanol solution of 3.5 g (20 mmol) of 1,2,3-propanetricarboxylic acid, and then the solution was stirred for 3 days at room temperature.

The reaction solution was concentrated under reduced pressure, then the residue was purified with silica gel chromatography to obtain 2.1 g (in 20% yield) of compound (13)

<Analysis Result of Compound (13)>

[1] 1H NMR (400 MHz, $CDCl_3$, room temperature): δ [ppm]=1.02 (tt, 18H, J=15.57, 6.49 Hz), 1.62 (dt, 6H, J=17.71, 5.38 Hz), 2.17 (s, 2H), 2.35 (dd, 2H, J=14.65, 5.04 Hz), 2.54-2.44 (m, 18H), 3.14-3.10 (m, 1H), 3.28 (dq, 6H, J=25.87, 6.56 Hz), 7.56 (3H, t, J=5.27 Hz)

[2] mass analysis (ESI-TOF): m/z=513.4603 (M+H)+

Production Example of Pigment Dispersion

Example 1

48 parts of polyester resin and 120 parts of ethyl acetate were added in a mixture of 12 parts of C.I. Pigment Yellow 155 (manufactured by Clariant, trade name "Toner Yellow 3GP") and 0.12 parts of compound (1), and then dispersed by Attritor (manufactured by NIPPON COKE & ENGINEERING CO., LTD.) for 3 hours to obtain pigment dispersion (1).

Example 2, 3

Pigment dispersion (2) and (3) were obtained by performing the same procedure as Example 1 except that toluene and ethyl methyl ketone were respectively used instead of ethyl acetate.

Example 4, 5

Pigment dispersion (4) and (5) were obtained by performing the same procedure as Example 1 except that compound (11) or (12) were respectively used instead of compound (1).

Example 6, 7

Pigment dispersion (6) and (7) were obtained by performing the same procedure as Example 1 except that a polyester resin was not added, and cyclohexanone and a mixture of ethyl acetate/toluene (60 parts/60 parts) were respectively used instead of ethyl acetate.

Example 8 to 10

Pigment dispersion (8), (9) and (10) were obtained by performing the same procedure as Example 1 except that a polyester resin was not added, compound (7), (4) or (5) was respectively used instead of compound (1), and a mixture of styrene/xylene (70 parts/50 parts) was used instead of ethyl acetate.

Example 11

60 parts water was added in a mixture of 6 parts of C.I. Pigment Yellow 155, 0.06 parts of compound (1), and 1.2 parts of sodium dodecyl sulfate, and then dispersed by Attritor (manufactured by NIPPON COKE & ENGINEERING CO., LTD.) for 3 hours to obtain pigment dispersion (11).

Example 12

Pigment dispersion (12) was obtained by performing the same procedure as Example 11 except that compound (13) was used instead of compound (1).

Comparative Example 1 to 7

Comparative pigment dispersion (1) to (7) were obtained by performing the same procedure as Example 1, 2, 3, 6, 7, 8 or 11 except that compound (1) or (7) were not added.

[Evaluation for Dispersibility]

The dispersibility of the pigment dispersion was evaluated by measuring the size of pigment particles in the pigment dispersion by using a particle size measuring instrument (Grindometer, TSTER SANGYO Co., Ltd.). When the size of pigment particles was less than 2.5 μm, the pigment dispersion was graded having good dispersibility.

A: The size of pigment particles is less than 2.5 μm.

B: The size of pigment particles is 2.5 or more and less than 4.5 μm.

C: The size of pigment particles is 4.5 μm or more.

In addition, the pigment dispersion was laid out on an aluminum plate and naturally dried to remove a solvent from the pigment dispersion and to obtain a sample. The dispersibility of the pigment dispersion was measured by enlarging the sample to 100,000 times by scanning electron microscope S-4800 (Hitachi, Ltd.).

Used materials and evaluation results of Example 1 to 12 and Comparative Example 1 to 7 are represented in Table 1. At Table 1, "PY155" stands for C.I. Pigment Yellow 155, and "particle size" stands for the size of pigment particles in the pigment dispersion.

TABLE 1

| | Pigment dispersion | Pigment | Resin | Compound represented by the general formula (1) | Addition ratio (%) | Solvent | Particle diameter (μm) | Evaluation for dispersibility |
|---|---|---|---|---|---|---|---|---|
| Example 1 | (1) | PY155 | Polyester | Compound (1) | 1 | Ethyl acetate | 2.2 | A |
| Example 2 | (2) | PY155 | Polyester | Compound (1) | 1 | Toluene | 2.3 | A |
| Example 3 | (3) | PY155 | Polyester | Compound (1) | 1 | Methyl ethyl ketone | 2.1 | A |
| Example 4 | (4) | PY155 | Polyester | Compound (11) | 1 | Ethyl acetate | 2.2 | A |
| Example 5 | (5) | PY155 | Polyester | Compound (12) | 1 | Ethyl acetate | 2.0 | A |
| Example 6 | (6) | PY155 | — | Compound (1) | 1 | Cyclohexanone | 1.9 | A |
| Example 7 | (7) | PY155 | — | Compound (1) | 1 | Ethyl acetate/Toluene (60/60) | 2.2 | A |
| Example 8 | (8) | PY155 | — | Compound (7) | 1 | Styrene/Xylene (70/50) | 1.9 | A |
| Example 9 | (9) | PY155 | — | Compound (4) | 1 | Styrene/Xylene (70/50) | 2.2 | A |
| Example 10 | (10) | PY155 | — | Compound (5) | 1 | Styrene/Xylene (70/50) | 2.3 | A |
| Example 11 | (11) | PY155 | — | Compound (1) | 1 | Water | 2.0 | A |
| Example 12 | (12) | PY155 | — | Compound (13) | 1 | Water | 2.4 | A |

| | Comparative pigment dispersion | Pigment | Resin | Compound represented by the general formula (1) | Addition ratio (%) | Solvent | Particle diameter (μm) | Evaluation for dispersibility |
|---|---|---|---|---|---|---|---|---|
| Comparative Example 1 | (1) | PY155 | Polyester | — | | Ethyl acetate | 4.6 | C |
| Comparative Example 2 | (2) | PY155 | Polyester | — | | Toluene | 3.9 | B |

TABLE 1-continued

| | | | | | | | |
|---|---|---|---|---|---|---|---|
| Comparative Example 3 | (3) | PY155 | Polyester | — | Methyl ethyl ketone | 4.7 | C |
| Comparative Example 4 | (4) | PY155 | — | — | Cyclohexanone | 5.0 | C |
| Comparative Example 5 | (5) | PY155 | — | — | Ethyl acetate/ Toluene (60/60) | 5.1 | C |
| Comparative Example 6 | (6) | PY155 | — | — | Styrene/Xylene (70/50) | 4.7 | C |
| Comparative Example 7 | (7) | PY155 | — | — | Water | 5.3 | C |

It is obvious from Table 1 that pigment dispersions of Example 1 to 12 have good pigment dispersibility in the dispersion medium in comparison with comparative pigment dispersions which doesn't contain a compound represented by the general formula (1).

Example 13

120 parts of styrene was added in a mixture of 12 parts of C.I. Pigment Yellow 155 and 0.12 parts of compound (1), and then they were dispersed by Attritor (manufactured by NIPPON COKE & ENGINEERING CO., LTD.) for 3 hours to obtain pigment dispersion (13).

Example 14

Pigment dispersion (14) was obtained by performing the same procedure as Example 13 except that 1.2 parts of compound (1) was used instead of 0.12 parts of compound (1).

Example 15 to 18

Pigment dispersion (15) to (18) were obtained by performing the same procedure as Example 13 except that compound (4), compound (5), compound (7) or compound (11) was respectively used instead of compound (1).

Example 19

Pigment dispersion (19) was obtained by performing the same procedure as Example 13 except that a mixture of C.I. Pigment Yellow 155 and C.I. Pigment Yellow 180 (96/24) was used instead of C.I. Pigment Yellow 155.

Example 20

Pigment dispersion (20) was obtained by performing the same procedure as Example 19 except that compound (12) was used instead of compound (1).

Example 21

Pigment dispersion (21) was obtained by performing the same procedure as Example 13 except that a mixture of C.I. Pigment Yellow 155 and C.I. Pigment Yellow 185 (90/30) was used instead of C.I. Pigment Yellow 155.

Example 22

Pigment dispersion (22) was obtained by performing the same procedure as Example 21 except that compound (13) was used instead of compound (1).

Comparative Example 8

Comparative Pigment dispersion (8) was obtained by performing the same procedure as Example 13 except that compound (1) was not used.

Comparative Example 9

Comparative Pigment dispersion 0) was obtained by performing the same procedure as Example 19 except that compound (1) was not used.

Comparative Example 10

Comparative Pigment dispersion (10) was obtained by performing the same procedure as Example 21 except that compound (1) was not used.

[Evaluation for Viscosity]

The viscosity of the pigment dispersion was measured by PHYSICA MCR RHEOMETER 300 (manufactured by Anton Paar). Viscosity lowering rates of pigment dispersion (13) to (18) were obtained with respect to comparative pigment dispersion (8), viscosity lowering rate of pigment dispersion (19) and (20) was obtained with respect to comparative pigment dispersion (9), and viscosity lowering rate of pigment dispersion (21) and (22) was obtained with respect to comparative pigment dispersion (10).

Cone-plate type measurement jig: 75 mm diameter, 1°

Shear speed: 10 $s^{-1}$

A: The viscosity lowering rate is 20% or more with respect to the comparative pigment dispersion.

B: The viscosity lowering rate is 10% or more and less than 20% with respect to the comparative pigment dispersion.

C: The viscosity lowering rate is less than 10% with respect to the comparative pigment dispersion.

[Evaluation for Dispersibility]

The dispersibility of the pigment dispersion was evaluated by measuring the size of pigment particles in the pigment dispersion by using a particle size measuring instrument (Grindometer, TSTER SANGYO Co., Ltd.). Evaluation criteria is the same as described above.

Figure 2:
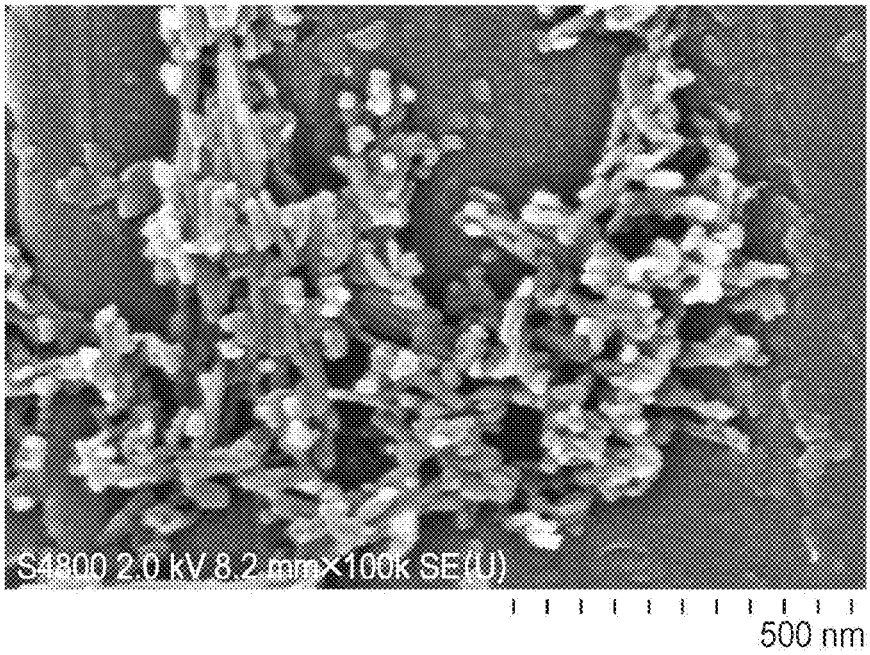
FIG. 2 is a SEM picture of a pigment dispersion (13) with a compound (1).

In addition, the pigment dispersion was laid out on an aluminum plate and naturally dried to remove a solvent from the pigment dispersion and to obtain a sample. The dispersibility of the pigment dispersion was measured by enlarging the sample to 100,000 times by scanning electron microscope S-4800 (Hitachi, Ltd.). The SEM picture of pigment dispersion (13) is shown in FIG. 2.

Used materials and evaluation results of Example 13 to 22 and Comparative Example 8 to 10 are represented in Table 2. At Table 2, "PY155", "PY180" and "PY185" respectively stands for C.I. Pigment Yellow 155, C.I. Pigment Yellow 180 and C.I. Pigment Yellow 185, and "particle size" stands for the size of pigment particles in the pigment dispersion.

TABLE 2

| | Pigment dispersion | Pigment | Compound represented by the general formula (1) | Addition ratio (%) | viscosity | Viscosity lowering rate (%) | Evaluation for viscosity | Particle diameter (μm) | Evaluation for dispersibility |
|---|---|---|---|---|---|---|---|---|---|
| Example 13 | (13) | PY155 | Compound (1) | 1 | 1865 | 30 | A | 2.1 | A |
| Example 14 | (14) | PY155 | Compound (1) | 10 | 2057 | 23 | A | 2.3 | A |
| Example 15 | (15) | PY155 | Compound (4) | 1 | 2091 | 22 | A | 2.1 | A |
| Example 16 | (16) | PY155 | Compound (5) | 1 | 1852 | 31 | A | 1.8 | A |
| Example 17 | (17) | PY155 | Compound (7) | 1 | 1782 | 33 | A | 2.1 | A |
| Example 18 | (18) | PY155 | Compound (11) | 1 | 1775 | 34 | A | 2.2 | A |
| Example 19 | (19) | PY155/PY180 (96/24) | Compound (1) | 1 | 1375 | 13 | B | 2.2 | A |
| Example 20 | (20) | PY155/PY180 (96/24) | Compound (12) | 1 | 1381 | 12 | B | 2.4 | A |
| Example 21 | (21) | PY155/PY185 (90/30) | Compound (1) | 1 | 1415 | 10 | B | 2.0 | A |
| Example 22 | (22) | PY155/PY185 (90/30) | Compound (13) | 1 | 1406 | 11 | B | 2.2 | A |

| | Comparative Pigment dispersion | Pigment | Compound represented by the general formula (1) | Addition ratio (%) | viscosity | Viscosity lowering rate (%) | Evaluation for viscosity | Particle diameter (μm) | Evaluation for dispersibility |
|---|---|---|---|---|---|---|---|---|---|
| Comparative Example 8 | (8) | PY155 | — | | 2674 | — | — | 5.5 | C |
| Comparative Example 9 | (9) | PY155/PY180 (96/24) | — | | 1575 | — | — | 3.8 | B |
| Comparative Example 10 | (10) | PY155/PY185 (90/30) | — | | 1575 | — | — | 4.0 | B |

It is obvious from Table 2 that viscosity increase of pigment dispersions of Example 13 to 22 were controlled in comparison with the corresponding comparative pigment dispersion. That is, the handling ability of the pigment dispersion is improved. Further, the pigment dispersion has good dispersibility of the pigment in the dispersion medium.

Production Example of Yellow Toner

Example 23

2 L four-necked flask equipped with a high speed stirring device (T.K. BOMO MIXER, manufactured by PRIMIX Corporation) was charged with 710 parts of ion-exchanged water and 450 parts of 0.1 mol/L-trisodium phosphate aqueous solution, adjusted its rotation speed to 12000 rpm, and heated at 60° C. 68 parts of 1.0 mol/L-calcium chloride aqueous solution was gradually added in the flask to prepare an aqueous dispersion medium containing fine particles of a hardly water-soluble dispersion stabilizer of calcium phosphate.

Pigment dispersion (13): 133.2 parts
Styrene monomer: 46.0 parts
n-butyl acrylate monomer: 34.0 parts
Aluminum salicylate compound: 2.0 parts
(Bontron E-88, manufactured by Orient Chemical Industries, Ltd.)
Polar resin: 10.0 parts
(A polycondensation compound of propylene oxide modified bisphenol A and isophthalic acid, Tg: 65° C., Mw: 10,000, Mn: 6,000)
Ester wax: 25.0 parts
(peak temperature of the highest endothermic peak in DSC: 70° C., Mn: 704)
Divinylbenzene monomer: 0.10 parts Materials described above were heated at 60° C., and dissolved and dispersed by T.K. HOMO MIXER at 5000 rpm. 10 parts of 2,2'-azobis(2,4-dimethylvaleronitrile) as a polymerization initiator was dissolved in the mixture to prepare a polymerizable monomer composition. This polymerizable monomer composition was added to the aqueous medium described above, and then granulated for 15 minutes at the rotation speed of 12000 rpm. The high-speed stirring device was replaced to a stirring apparatus with a propeller stirring blade, and the polymerization was maintained at 60° C. of liquid temperature for 5 hours. And then, liquid temperature was risen to 80° C., the polymerization was further maintained for 8 hours. After polymerization, a monomer residue was removed at 80° C. under reduced pressure, and then the resultant was cooled at 30° C. to obtain dispersion of polymer fine particles.

After transferring the dispersion of polymer fine particles to a washing container, diluted hydrochloric acid was added to the dispersion with stirring to adjust its pH to 1.5, and then the dispersion was further stirred for 2 hours. The dispersion was subjected to solid-liquid separation by a filter to obtain polymer fine particles. The procedure of dispersing the polymer fine particles into water and subjecting to solid-liquid separation was repeated until a phosphate compound and a calcium compound including calcium phosphate were sufficiently removed. Finally, polymer fine particles subjected to solid-liquid separation were sufficiently dried by a drier to obtain yellow toner particle (1).

1.00 parts of a hydrophobic silica fine powder surface-treated with hexamethyldisilazane (number average primary particle diameter: 7 nm), 0.15 parts of a rutile type titanium oxide fine powder (number average primary particle diameter: 45 nm), and 0.50 parts of a rutile type titanium oxide fine powder (number average primary particle diameter: 200 nm) were added to 100 parts of yellow toner particle (1), and they are mixed in dry-process for 5 minutes by Henschel mixer (manufactured by NIPPON COKE & ENGINEERING. Co., Ltd) to obtain yellow toner 1.

Example 24

Yellow toner 2 was obtained by performing the same procedure as Example 23 except that an aluminum salicylate compound was not used.

Example 25 to 28

Yellow toner 3 to 6 were obtained by performing the same procedure as Example 23 except that pigment dispersion (15), (16), (17) or (18) were respectively used instead of pigment dispersion (13).

Example 29

Yellow toner 7 was obtained by performing the same procedure as Example 23 except that pigment dispersion (20) was used instead of pigment dispersion (13).

Example 30, 31

Yellow toner 8 and 9 were obtained by performing the same procedure as Example 23 except that pigment dispersion (21) or (22) were respectively used instead of pigment dispersion (13).

Comparative Example 11

Comparative yellow toner 1 was obtained by performing the same procedure as Example 24 except that comparative pigment dispersion (8) was used instead of pigment dispersion (13).

Comparative Example 12

Comparative yellow toner 2 was obtained by performing the same procedure as Example 23 except that comparative pigment dispersion (9) was used instead of pigment dispersion (13).

Comparative Example 13

Comparative yellow toner 3 was obtained by performing the same procedure as Example 23 except that comparative pigment dispersion (10) was used instead of pigment dispersion (13).

Yellow toner 1 to 7 were evaluated as shown below.

(1) Measurement of Weight Average Particle Diameter D4 and Number Average Particle Diameter D1 of Toner Number average particle diameter (D1) and weight average particle diameter (D4) of the toner was measured by grain size distribution analysis of Coulter method. Coulter Multisizer II (manufactured by Beckman Coulter, Inc.) was used to measure D1 and D4 of the toner in accordance with the operation manual of the device. ISOTON-II (manufactured by Beckman Coulter, Inc.) was used as an electrolyte. Concrete measurement method was shown below. 0.1 ml of a surfactant (an alkyl benzene sulfonate salt) as a dispersant and about 2 mg of sample (toner) were added in 100 ml of the electrolyte aqueous solution. Electrolyte with suspension of the sample was treated by an ultrasonic dispersion device for about 1 to 3 minutes. The treated dispersion was measured by the measurement device equipped with 100 μm aperture, and the volume and the number of particles of toner having the diameter of 2.00 μm or more were obtained to calculate the volume distribution and the number distribution of the toner. Number average particle diameter (D1) was calculated from the number distribution of the toner, and the weight average particle diameter (D4) of the toner was calculated from volume distribution of the toner to obtain D4/D1. In each channels, a median value was used as a representative value.

13 channels of 2.00-2.52 μm, 2.52-3.17 μm, 3.17-4.00 μm, 4.00-5.04 μm, 5.04-6.35 μm, 6.35-8.00 μm, 8.00-10.08 μm, 10.08-12.70 μm, 12.70-16.00 μm, 16.00-20.20 μm, 20.20-25.40 μm, 25.40-32.00 μm, and 32.00-40.30 μm were used as the channels described above.

(2) Measurement of Average Circularity of Toner

Flow-type particle image analyzer "FPIA-2100" (manufactured by Sysmex Corporation) was used to measure the average circularity of the toner. The circularity was calculated by using the following equation.

$$\text{equivalent circle diameter} = \sqrt{\text{particle projected area}/\pi} \times 2.$$

$$\text{Circularity} = \frac{\text{perimeter length of circle having in the same area as particle projected area}}{\text{perimeter length of particle projection image}}$$

In the equation, "particle projected area" is defined as the area of a binary image of a particle of toner. "Perimeter length of particle projection image" is defined as a length of contour line obtained by drawing lines so as to connect edges of the toner particle image. Circularity is an index representing concavo-convex degree of a particle, and when a particle is a perfect sphere, the circularity of the particle is 1.000. The more complicated surface shape a particle has, the smaller value the circularity becomes.

(3) Evaluation for Coloring Power of Toner

Under normal-temperature and normal-humidity environment (temperature 25° C./humidity 60% RH), 16-tone image sample whose max toner loading amount was adjusted to 0.45 mg/cm$^2$ was prepared by a reconstructed apparatus of color copying machine CLC-1100 (manufactured by Canon Inc., omitted fixing oil-applying mechanism). CLC color copy paper (manufactured by Canon Inc.) was used as a recording medium for an image sample. Obtained image sample was analyzed by SpectroLino (manufactured by GretagMacbeth). Analyzed result was evaluated in terms of the yellow color density, OD(Y).

A: OD(Y) is 1.6 or more (very good coloring power)

B: OD(Y) is 1.5 or more and less than 1.6 (good coloring power)

C: OD(Y) is less than 1.5 (bad coloring power)

TABLE 3

| | Yellow Toner | Pigment dispersion | Pigment | D50 (μm) | D4/D1 | Circularity of toner | Evaluation for coloring power |
|---|---|---|---|---|---|---|---|
| Example 23 | yellow toner 1 | pigment dispersion (13) | PY155 | 4.95 | 1.25 | 0.980 | 1.68/A |
| Example 24 | yellow toner 2 | pigment dispersion (13) | PY155 | 6.54 | 1.23 | 0.957 | 1.64/A |
| Example 25 | yellow toner 3 | pigment dispersion (15) | PY155 | 5.05 | 1.30 | 0.961 | 1.70/A |
| Example 26 | yellow toner 4 | pigment dispersion (16) | PY155 | 5.68 | 1.28 | 0.955 | 1.62/A |
| Example 27 | yellow toner 5 | pigment dispersion (17) | PY155 | 5.12 | 1.25 | 0.981 | 1.70/A |

TABLE 3-continued

| | Yellow Toner | Pigment dispersion | Pigment | D50 (μm) | D4/D1 | Circularity of toner | Evaluation for coloring power |
|---|---|---|---|---|---|---|---|
| Example 28 | yellow toner 6 | pigment dispersion (18) | PY155 | 6.08 | 1.28 | 0.968 | 1.61/A |
| Example 29 | yellow toner 7 | pigment dispersion (20) | PY155/PY180 (96/24) | 6.15 | 1.66 | 0.980 | 1.69/A |
| Example 30 | yellow toner 8 | pigment dispersion (21) | PY155/PY185 (90/30) | 6.66 | 1.70 | 0.982 | 1.73/A |
| Example 31 | yellow toner 9 | pigment dispersion (22) | PY155/PY185 (90/30) | 6.49 | 1.78 | 0.966 | 1.71/A |
| Comparative Example 11 | comparative yellow toner 5 | comparative pigment dispersion (8) | PY155 | 7.83 | 1.61 | 0.957 | 1.47/C |
| Comparative Example 12 | comparative yellow toner 6 | comparative pigment dispersion (9) | PY155/ Y180 (96/24) | 4.74 | 1.28 | 0.977 | 1.49/B |
| Comparative Example 13 | comparative yellow toner 7 | comparative pigment dispersion (10) | PY155/PY185 (90/30) | 8.58 | 2.16 | 0.957 | 1.54/B |

It is obvious from Table 3 that toners produced with pigment dispersions of Example 23 to 31 had few coarse particles, and showed preferable coloring power.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-072822, filed Mar. 29, 2011, which is hereby incorporated by reference herein in its entirety.

What is claimed is:

1. A pigment dispersion containing a compound represented by general formula (1) and a yellow pigment represented by general formula (2) in a dispersion medium:

General Formula (1)

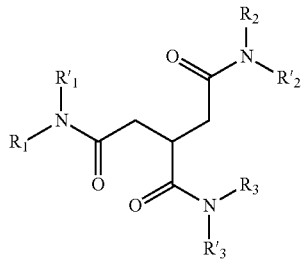

General Formula (2)

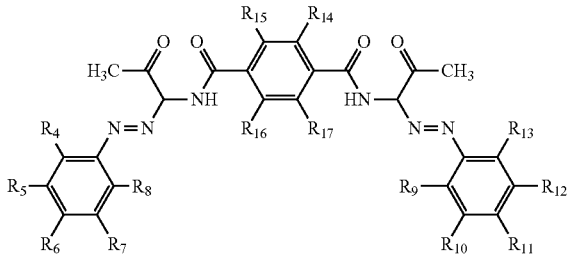

in the general formula (1), $R_1$, $R_2$, $R_3$, $R'_1$, $R'_2$, and $R'_3$ represent a hydrogen atom, an alkyl group, an aryl group or an aralkyl group, respectively; and in the general formula (2), $R_4$, $R_5$, $R_6$, $R_7$, $R_8$, $R_9$, $R_{10}$, $R_{11}$, $R_{12}$, and $R_{13}$ represent a hydrogen atom, an alkyl group, a carboxylate ester group, a carboxylic amide group or a halogen atom, respectively, and $R_{14}$, $R_{15}$, $R_{16}$, and $R_{17}$ represent a hydrogen atom, an alkyl group or a halogen atom, respectively, wherein the content of the compound represented by the general formula (1) is in the range of 0.05 to 10 parts by mass with respect to 100 parts by mass of the yellow pigment represented by the general formula (2).

2. The pigment dispersion according to claim 1, wherein $R_1$, $R_2$, and $R_3$ represent the same substituent, and $R'_1$, $R'_2$, and $R'_3$ represent the same substituent.

3. The pigment dispersion according to claim 1, wherein $R_1$, $R_2$, and $R_3$ represent alkyl group, respectively, and $R'_1$, $R'_2$, and $R'_3$ represent a hydrogen atom.

4. The pigment dispersion according to claim 1, wherein the yellow pigment represented by the general formula (2) is C.I. Pigment Yellow 155.

5. The pigment dispersion according to claim 1, wherein in general formula (1), $R_1$, $R_2$ and $R_3$ include at least one of a ring structure, a branched structure and a hetero atom.

6. The pigment dispersion according to claim 1, wherein the compound represented by general formula (1) corresponds to at least one of Compounds (1)-(13):

Compound (1)

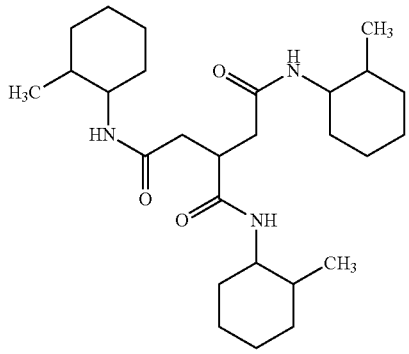

Compound (2)

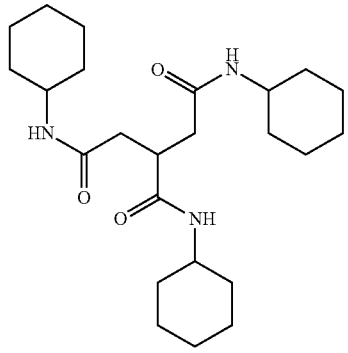

-continued
Compound (3)
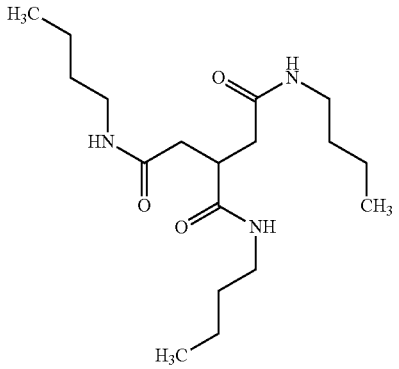
Compound (4)
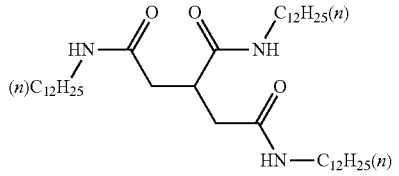
Compound (5)
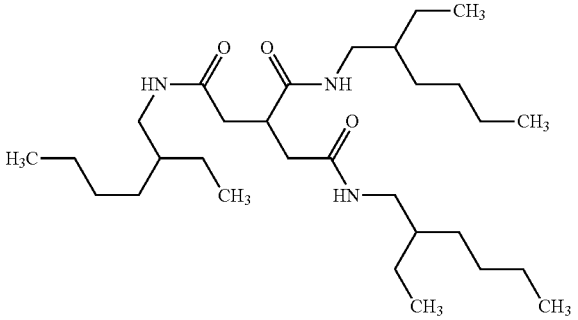
Compound (6)
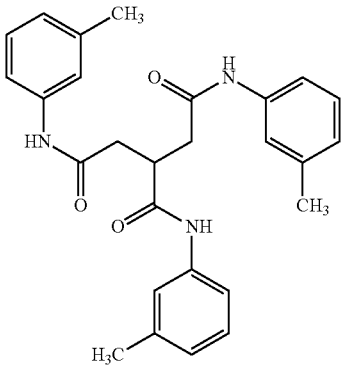
Compound (7)
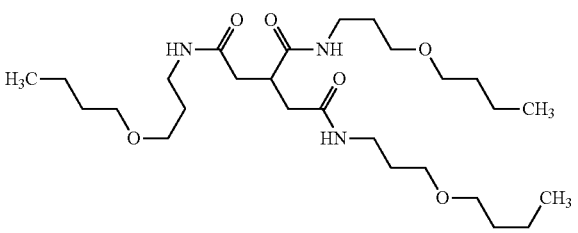
-continued
Compound (8)
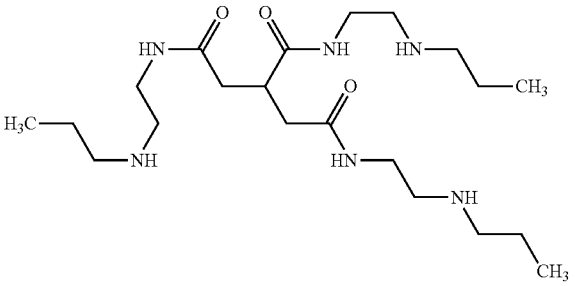
Compound (9)
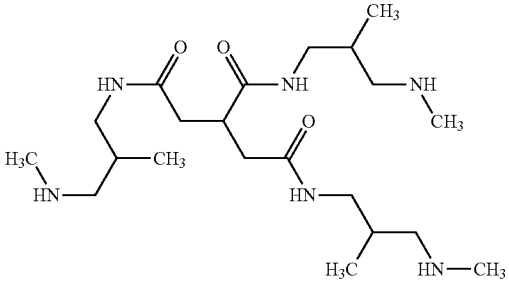
Compound (10)
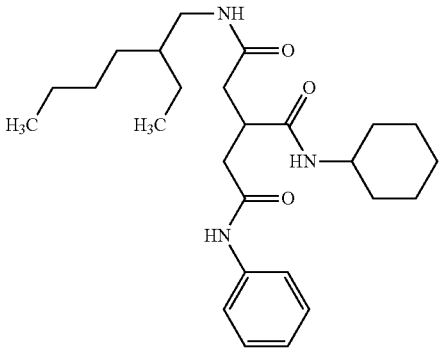
Compound (11)
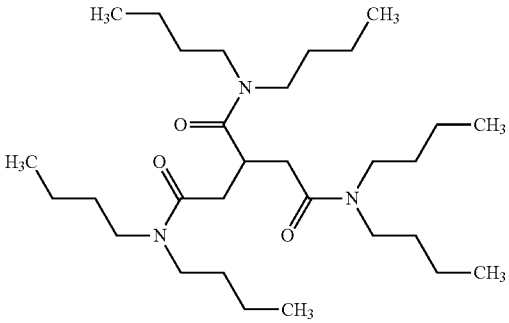
Compound (12)
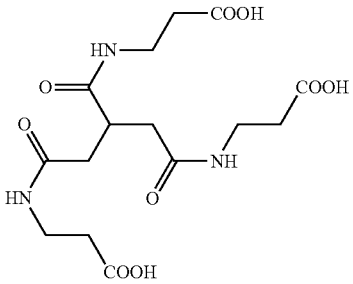

-continued
Compound (13)
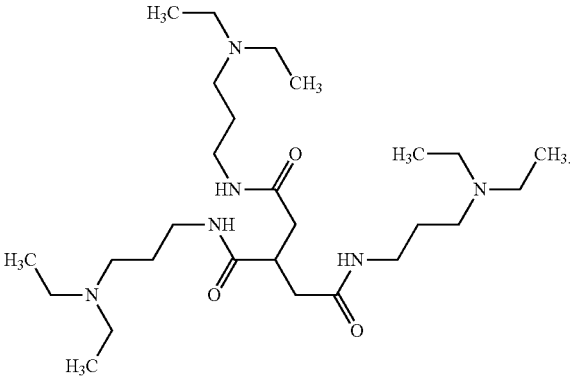
* * * * *